US008393098B2

(12) United States Patent
Roth et al.

(10) Patent No.: US 8,393,098 B2
(45) Date of Patent: Mar. 12, 2013

(54) FOAM GREETING CARD MASK

(75) Inventors: Rob Roth, Hudson, OH (US); Annie Deckerd, Elyria, OH (US)

(73) Assignee: American Greetings Corporation, Cleveland, OH (US)

( * ) Notice: Subject to any disclaimer, the term of this patent is extended or adjusted under 35 U.S.C. 154(b) by 11 days.

(21) Appl. No.: 13/556,631

(22) Filed: Jul. 24, 2012

(65) Prior Publication Data

US 2012/0285054 A1 Nov. 15, 2012

Related U.S. Application Data

(63) Continuation-in-part of application No. 13/459,553, filed on Apr. 30, 2012.

(51) Int. Cl.
*G09F 1/00* (2006.01)

(52) U.S. Cl. ..... 40/124.03; 40/124.12; 12/206

(58) Field of Classification Search ..... 40/124.03, 40/124.12; 2/206
See application file for complete search history.

(56) References Cited

U.S. PATENT DOCUMENTS 730,357 A * 6/1903 Eschenbach ..... 2/206
2,927,400 A 3/1960 Bailey
4,055,014 A * 10/1977 Schmidt et al. ..... 40/442
5,743,035 A 4/1998 Bradley et al.
5,822,801 A * 10/1998 Varney ..... 2/206
6,357,152 B1 3/2002 Brooks et al.
6,460,277 B1 10/2002 Tower
6,848,965 B2 2/2005 Wong
7,201,402 B2 4/2007 Duprey
7,634,864 B2 12/2009 Segan
2003/0230501 A1* 12/2003 Smolev ..... 206/232
2004/0003446 A1* 1/2004 MacDonald ..... 2/9
2006/0010732 A1* 1/2006 Gardi ..... 40/124
2008/0032587 A1 2/2008 Krivanek et al.
2009/0126239 A1 5/2009 Clegg
2009/0241387 A1 10/2009 Wong
2009/0318052 A1* 12/2009 Prescott ..... 446/148
2010/0325923 A1* 12/2010 Dial ..... 40/124.03
2012/0110879 A1 5/2012 Qiao et al.

* cited by examiner

*Primary Examiner* — Gary Hoge
(74) *Attorney, Agent, or Firm* — James C. Scott; Roetzel & Andress

(57) ABSTRACT

Three-dimensional lightweight foam greeting cards are described herein having a foam body with a perimeter wall that extends between two spaced apart parallel pieces of planar sheet material such as heavy gauge paper, cardboard, or other such material. The greeting cards have a partially hollowed foam body or one or more cavities in the foam body concealed in the front and back by the planar sheet material which may be pre-cut in the shape of the foam body are decorated consistent with the design of the foam body. The cavities in the foam body may contain various electronic components that enable the greeting card to produce sound, record and playback a personalized message, trigger light activation, trigger the movement of moveable parts, display digital video, photographs or slideshows, or a combination thereof.

20 Claims, 8 Drawing Sheets

FOAM GREETING CARD MASK

RELATED APPLICATIONS

This application is a continuation-in-part of and claims priority to U.S. patent application Ser. No. 13/459,553, filed on Apr. 30, 2012, which claims priority to Ser. No. 13/004,544, filed on Jan. 11, 2011. Each of the above-referenced patent applications is incorporated herein by reference in its entirety.

FIELD OF THE INVENTION

The present invention relates to greeting cards, and more specifically to three-dimensional foam greeting cards and decorative greeting card accessories.

BACKGROUND OF THE INVENTION

For many years paper greeting cards have been widely used for celebratory occasions such as birthdays, graduations, weddings and other commercial purposes. Traditional text information is generally found on paper greeting cards. More recently, sound has been added to traditional paper greeting cards to increase the personalization of the cards by delivering an audio message that is electronically embodied in circuitry that is carried within the greeting card. The ability to use sound in combination with printed matter such as with conventional printed greeting cards significantly enhances the communicative value of social and relational greetings. The availability of small voice recording sound modules has made sound-generating greeting cards increasingly popular. Small lighting systems have also been incorporated into social greeting products and novelties, and combined in circuits with sound and other features.

SUMMARY OF THE INVENTION

A three-dimensional foam greeting card is described herein, in one embodiment, having a three-dimensional foam body, a first planar surface material attached to a front surface of the three-dimensional foam body, a second planar surface material attached to a back surface of the three-dimensional foam body and a sound module located in a recess in the three-dimensional foam body and concealed by the first and second planar surface material. The sound module may include a speaker, circuit board, integrated circuit, microprocessor, memory device, power source, at least one switch mechanism and at least one pre-loaded digital audio file. The at least one switch mechanism controls playback of the at least one pre-loaded digital audio file.

In another embodiment, the three-dimensional foam greeting card of the present invention contains a three-dimensional foam body having at least one hollowed out portion creating a cavity therein, a first planar surface attached to a front surface of the three-dimensional foam body, a second planar surface attached to a back surface of the three-dimensional foam body, a sound module comprising a speaker, circuit board, integrated circuit, microprocessor, power source, memory device and at least one pre-loaded audio file, a recording device, a first switch to initiate a user recording session, and a second switch to initiate playback of the at least one pre-loaded audio file or a user recorded message.

In still another embodiment, the foam greeting card contains a three-dimensional foam body with a perimeter wall which extends between two spaced apart parallel pieces of heavy gauge planar sheet material, and a multimedia player device located and concealed within the three-dimensional foam body. The multimedia player device may include a circuit board, integrated circuit, microprocessor, speaker, power source, memory device, an electronic display screen operative to display digitally generated images, a data storage device, at least one switch mechanism, and at least one pre-loaded digital audio or video file. The electronic display screen is visible through an opening in the three-dimensional foam body and one of the pieces of heavy gauge planar sheet material.

DETAILED DESCRIPTION OF PREFERRED AND ALTERNATE EMBODIMENTS

The present disclosure and related inventions provide foam constructs in the form of greeting devices, greeting cards, novelties, gifts and foam constructs with functional features, and which can be used in connection with other devices such as retail displays.

Figure 3:
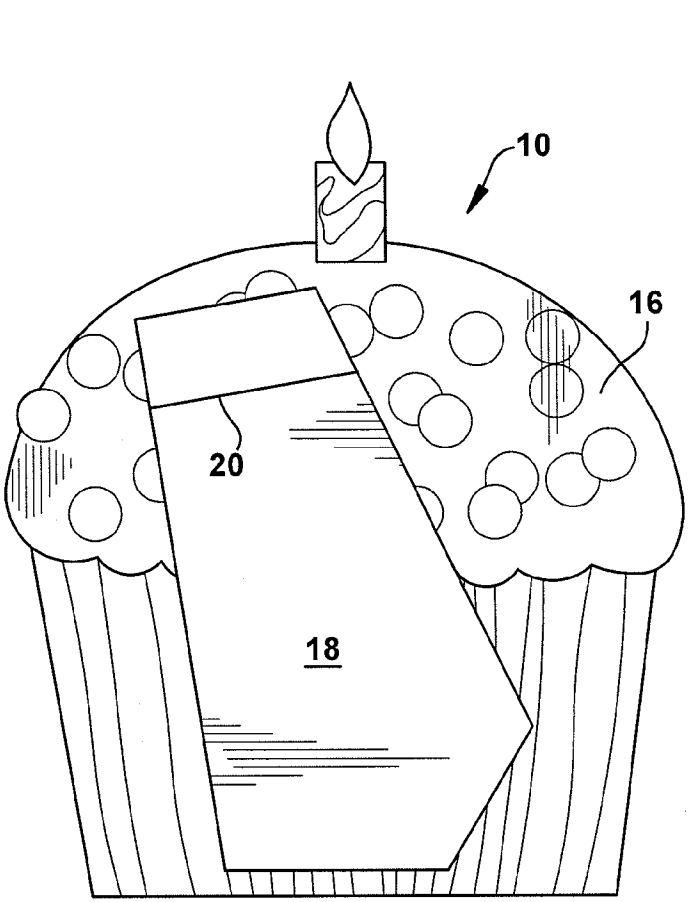
FIG. 3 is a rear view of the three-dimensional foam greeting card of FIG. 1.
Figure 2:
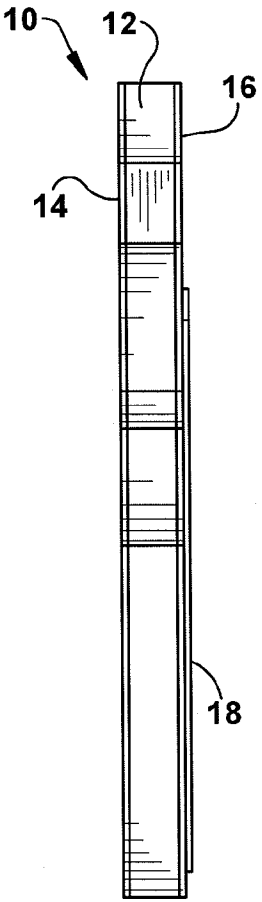
FIG. 2 is a side view of the three-dimensional foam greeting card of FIG. 1.
Figure 9:
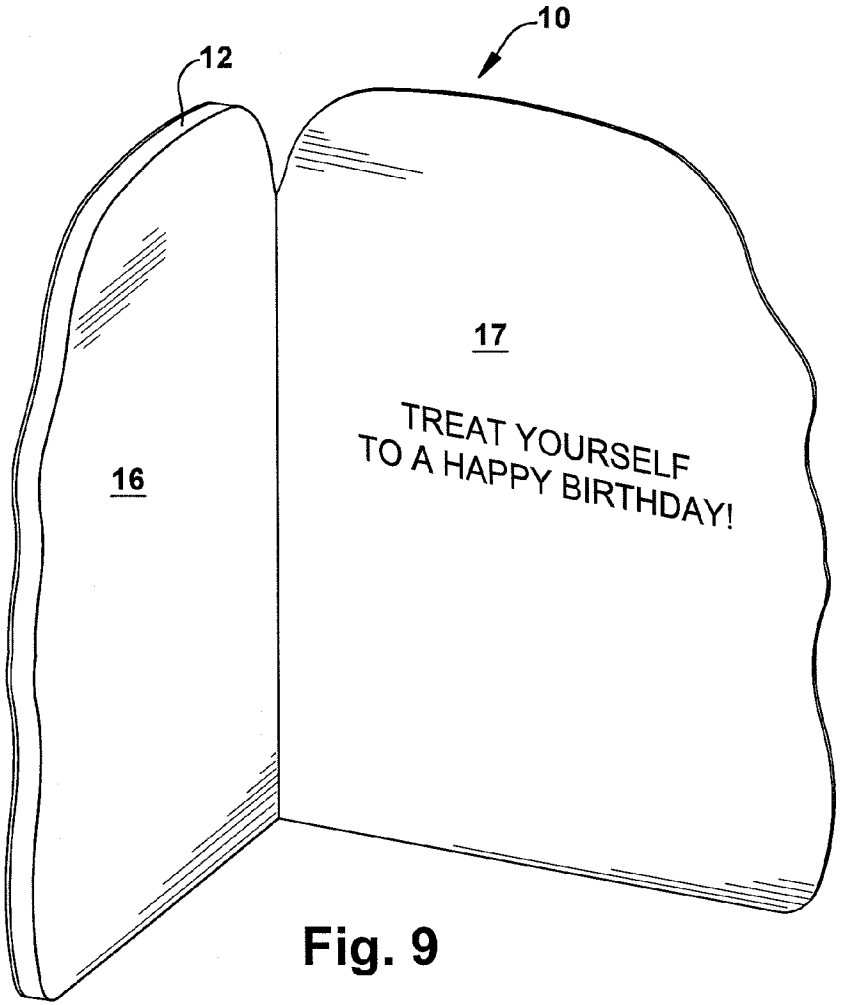
FIG. 9 is a perspective view of the three-dimensional foam greeting card of FIG. 8 in an open position.
Figure 8:
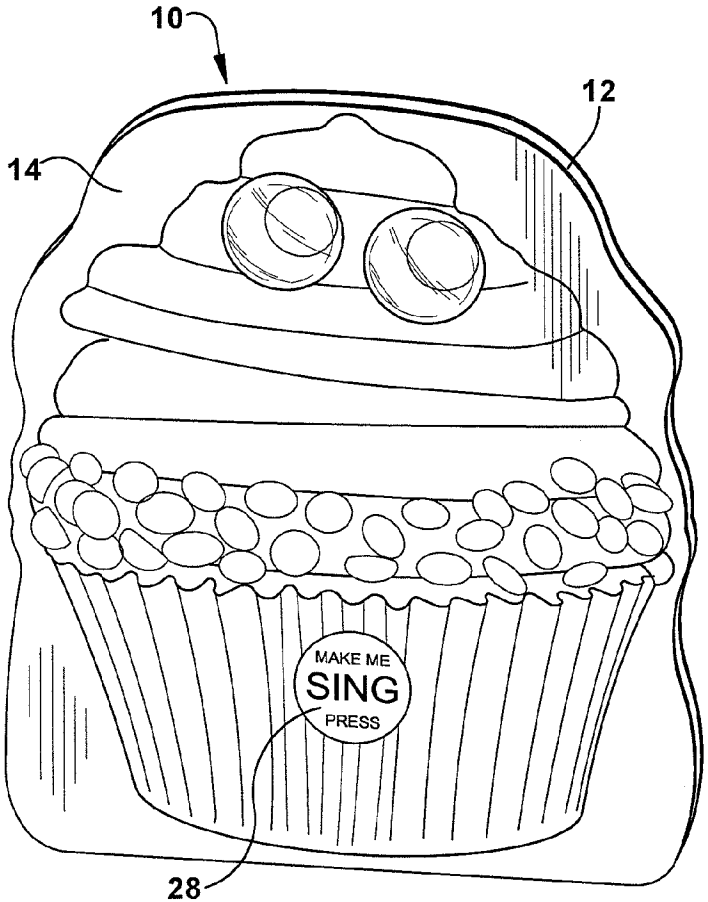
FIG. 8 is a front view of an alternate embodiment of the three-dimensional foam greeting card of the present invention in a closed position.

In one form, a three-dimensional foam greeting card according to the present invention contains a foam body made of a hardened foam or foam-like material which makes the greeting card very lightweight. A representative example is shown in FIGS. 1-4. The foam body 12 of the greeting card 10 can be formed into any shape or profile, examples of which include, but are not limited to: a circle, a cupcake, a candle, an animal, a person, a baby carriage, a Christmas tree, a pumpkin, or any other conceivable shape. Or the greeting card 10 may take on a square or rectangular shape of a traditional greeting card. A portion of the foam body 12 is hollowed out to accommodate a device, examples of which include, but are not limited to: a sound module (shown in FIG. 4), a light module, a motor module, a multimedia player device or any combination thereof. There may be multiple cavities formed in the foam body 12 to receive multiple devices or device components such as batteries, switches, circuit boards, speakers, motors, recording devices, etc. The front and back surfaces of the foam body 12 are generally planar and can be covered with a heavy gauge paper-like material such as paper, cardboard, cardstock, or any other sheet or planar material. The outer paper-like surface 14, 16 can be cut in the shape of the foam body 12 and pre-printed with a design consistent with the shape of the foam body 12. The front surface 14 may bear decoration consistent with a front view of the item and the back surface 16 may contain decoration consistent with the back view of the item. For example, if the foam body and outer cover contain the shape and decoration of a dog, the front cover of the foam greeting card may contain the right side profile of the dog and the back cover may contain the left side profile of the dog. The outer surfaces 14, 16 are adhesively or otherwise attached to the foam body 12. The greeting card 10 may contain, in addition to the three-dimensional foam body 12 with planar front 14 and back 16 surfaces, a sentiment panel 17, which may be connected to the planar sheet material located on either the front 14 or back 16 surface of the foam body 12. This configuration is shown in FIGS. 8 and 9. The sentiment panel 17 may be, as shown, shaped in the same way as the foam body 12 and corresponding front 14 and back 16 sheet materials. If the sentiment panel 17 is connected along a fold line to the planar sheet material located on the front surface 14 of the foam body 12, it would serve as an outside front cover and an inside left panel of the greeting card 10. In a closed position, the sentiment panel 17 would be folded over the front surface 14 of the foam body 12 revealing only the outer surface of the sentiment panel 17. In an open position, it would be folded away from and revealing the front surface 14 of the greeting card 10 and the inner surface of the sentiment panel 17. Text sentiment and/or printed photographs or graphics may be contained on both the inside and outside surface of the sentiment panel. If the sentiment panel is connected along a fold line to the planar sheet material located on the back surface 16 of the foam body 12, as is shown in FIG. 9, it would serve as an outside back cover of the greeting card 10 and an inside right panel of the greeting card 10. In a closed position, the sentiment panel 17 would be folded over the back surface 16 of the greeting card 10. In an open position, it would be folded away from the back surface 16 of the greeting card 10 revealing the back surface 16 of the greeting card 10 and the inner surface of the sentiment panel 17. The three-dimensional greeting card 10 may additionally contain a display arm 18 attached to the back surface 16 of the greeting card 10, as shown in FIG. 3. The display arm 18 may be made out of cardboard or other rigid material. The upper portion of the display arm 18 is creased along a fold line 20 so that the display arm 18 may bend outward to function as a support for the greeting card 10, allowing the greeting card 10 to be displayed in a standing position.

Figure 4:
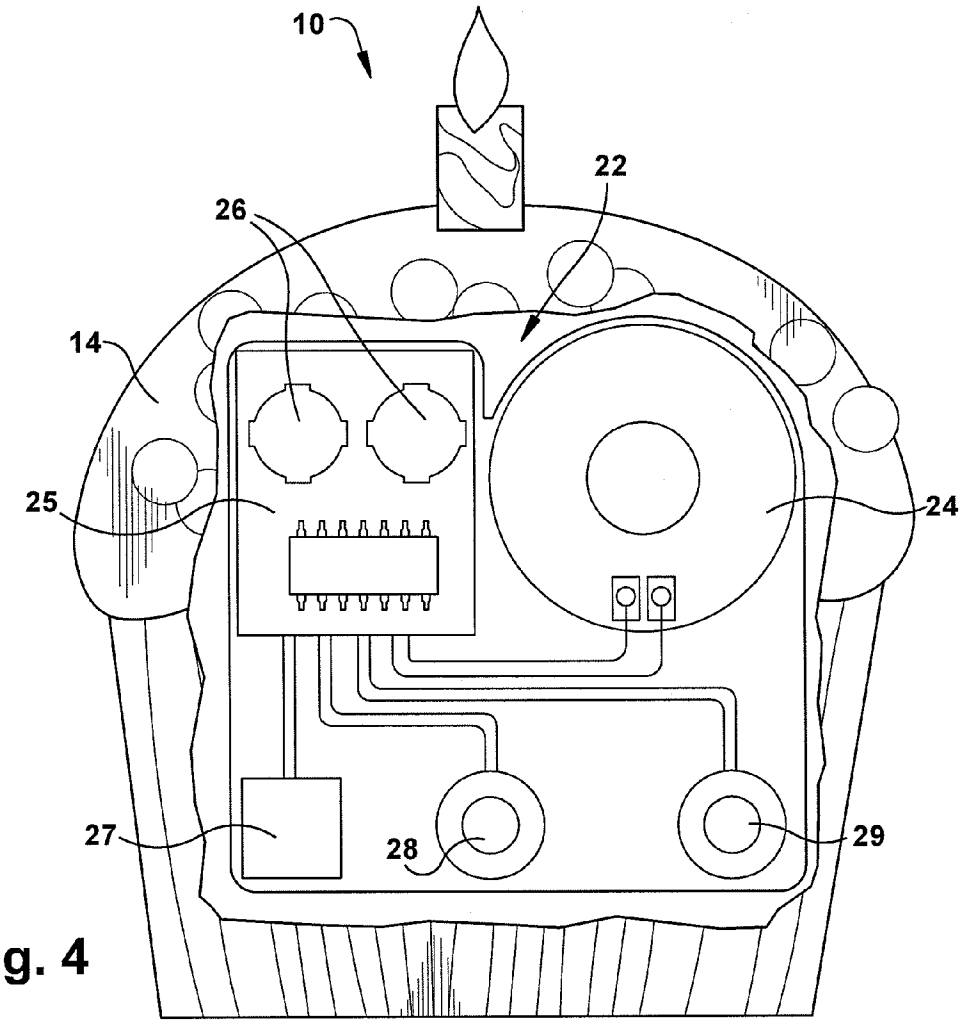
FIG. 4 is a front internal view of the three-dimensional foam greeting card of FIG. 1.

In another embodiment, the foam greeting card, as described above, may contain a sound module 22, as shown in FIG. 4. Components of the sound module may include a circuit board 25, an integrated circuit, a microprocessor, a speaker 24, a memory module, a power source 26, a switch 28, and any other components necessary to trigger and playback a pre-recorded digital audio file. The digital audio file may contain music, singing, a voice message, or any other recordable sound. Components of the sound module 22 may be contained and concealed within a hollowed out portion of the foam body 12. The switch 28 which triggers playback of the audio file may be an electro-mechanical push-button switch 28. This type of switch may be implemented as a press-button 28, wherein each time a user presses the button, playback of the audio file is initiated. A sticker or printed label may be placed above the press-button switch on the outer surface 14 of the greeting card 10 to indicate that this is the area the user must press to playback the audio file. The sticker or printed label may simply say "play" or "press here". Alternatively the surface of the greeting card 10 above the press-button may be printed with words and/or indicators to designate the location of the push-button 28. The switch may alternatively be a mechanical on/off switch which may be located on the front or back surface of the foam greeting card or it may also be located along the perimeter of the foam body 12. A slide trigger switch may also be used to initiate playback of the pre-recorded digital audio file. This type of switch may be particularly used with a foam greeting card having a sentiment panel, as described above, attached to the front or back surface of the greeting card. A slide switch mechanism may be placed over a fold line between the sentiment panel and the foam body such that when the greeting card is opened by moving the sentiment panel away from the foam body, the slide trigger activates the pre-recorded audio. Other switch mechanisms may be used such as light sensitive switches, motion sensitive switches, touch sensitive switches, pressure sensitive switches, thermal switches, moisture or capacitive switches or any other switch which would be known to one skilled in the art.

Figure 1:
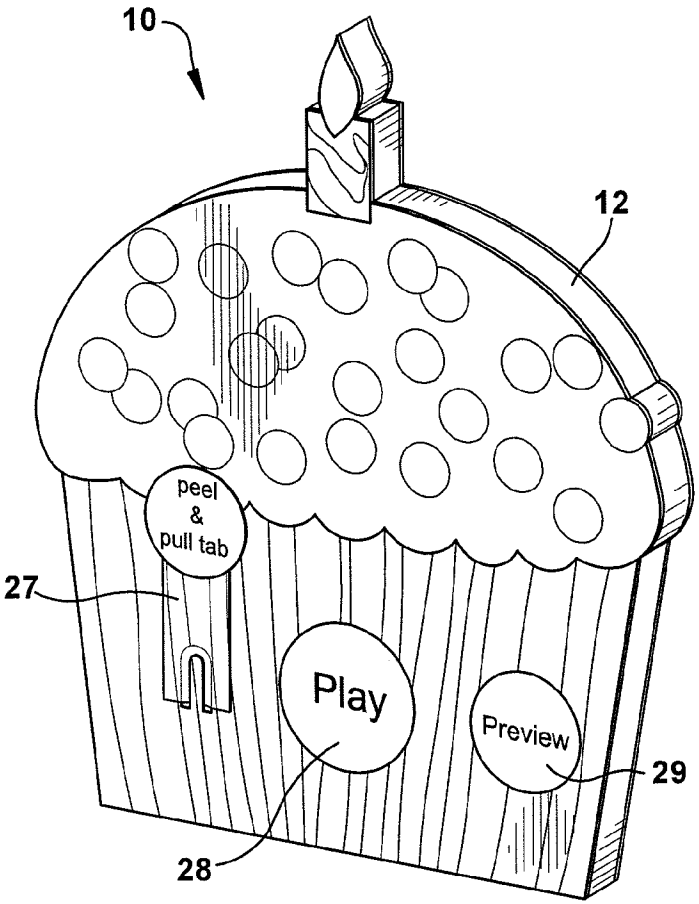
FIG. 1 is a perspective view of a first embodiment of the three-dimensional foam greeting card of the present invention.

In another embodiment, the three-dimensional foam greeting card, as described above, contains both a sound and recording module that provide the user with the ability to record a personalized message to the card recipient. As shown in FIGS. 1 and 4, this embodiment may include at least two electro-mechanical switches 28, 29 to initiate a recording session and a playback session and a microphone. A first switch 28 or "play" button, which may be implemented as a push-button switch as described above, may in a first mode initiate playback of a pre-recorded message instructing the user how to record a personal message and in a second mode initiate playback of the user's personal message. A second switch 29, or "preview" button, which may also be implemented as a push-button, may initiate a recording session wherein the user may record a personal message to the greeting card recipient. A third switch 27 or pull tab is located on the outer surface of the greeting card. This third switch 27 controls whether the greeting card 10 is in a first mode, wherein a user can test the card functionality by recording and previewing the recorded message without the ability to play the message a second time or to hear the message upon pressing the "play" button, or a second mode, wherein the user has purchased the greeting card, and removed the pull tab 27 thereby permitting the user to record a message which is then saved within the sound module and is thereby available for playback upon pressing the "play" button 28. The third switch or pull tab 27 may be located on the outer surface of the greeting card 10 so that is visible to the purchaser. While the pull tab 27 is still intact, pressing the "play" button will initiate playback of a pre-recorded voice message instructing the user how to record a personal message. Once the pull tab 27 has been removed, pressing the "play" button 28 will initiate playback of the user-recorded message. Pressing the "preview" button 29 initiates a recording session, regardless of whether the pull tab 27 has been removed or not. The recording session will continue as long as the user continues pressing or holding down the "preview" button 29 or until the amount of storage allotted for the user-recorded message has been exhausted. Once the user has finished recording the personal message, the personal message will automatically be played back. In the first mode, when the pull tab 27 is still intact, the user-recorded message is played back once and discarded, disabling further playback of the user-recorded message. In the second mode, once the pull tab 27 has been removed, the user-recorded message is immediately played back and saved so that it can be re-played by pressing the "play" button 28. The user may record over a previous message simply by pressing the "preview" button 29 and recording a new message which will overwrite the previously saved user-recorded message. The "preview" button 29 may be indicated on the outer surface of the greeting card by a removable sticker or label. Once the user purchases the greeting card and has recorded a satisfactory message, he/she can remove the "preview" sticker or label before sending the greeting card to the recipient.

Figure 6:
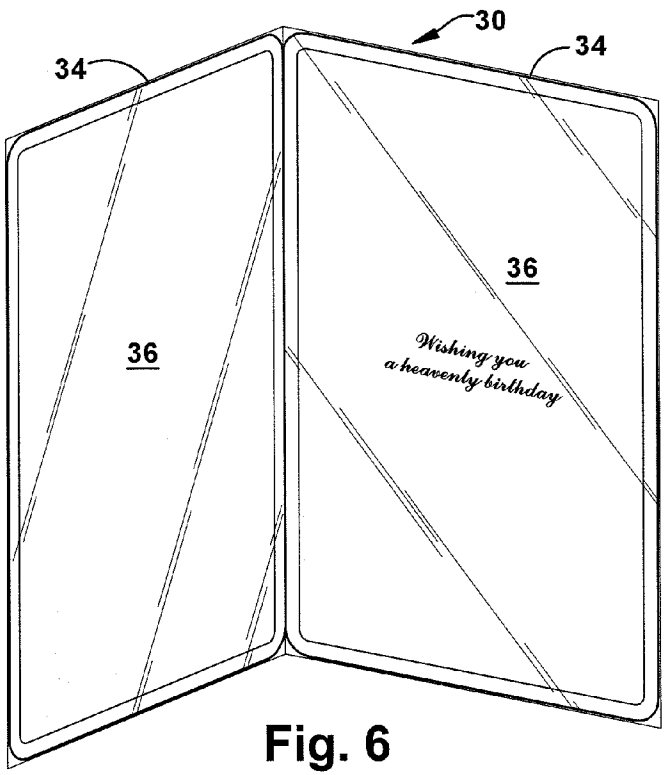
FIG. 6 is a perspective view of the three-dimensional foam greeting card of FIG. 5 in an open position.
Figure 7:
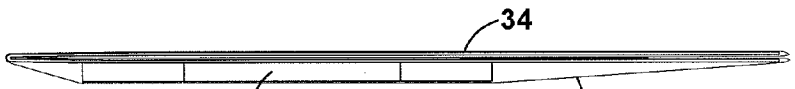
FIG. 7 is a top view of the three-dimensional foam greeting card of FIG. 5 in the direction of arrows 7-7.
Figure 5:
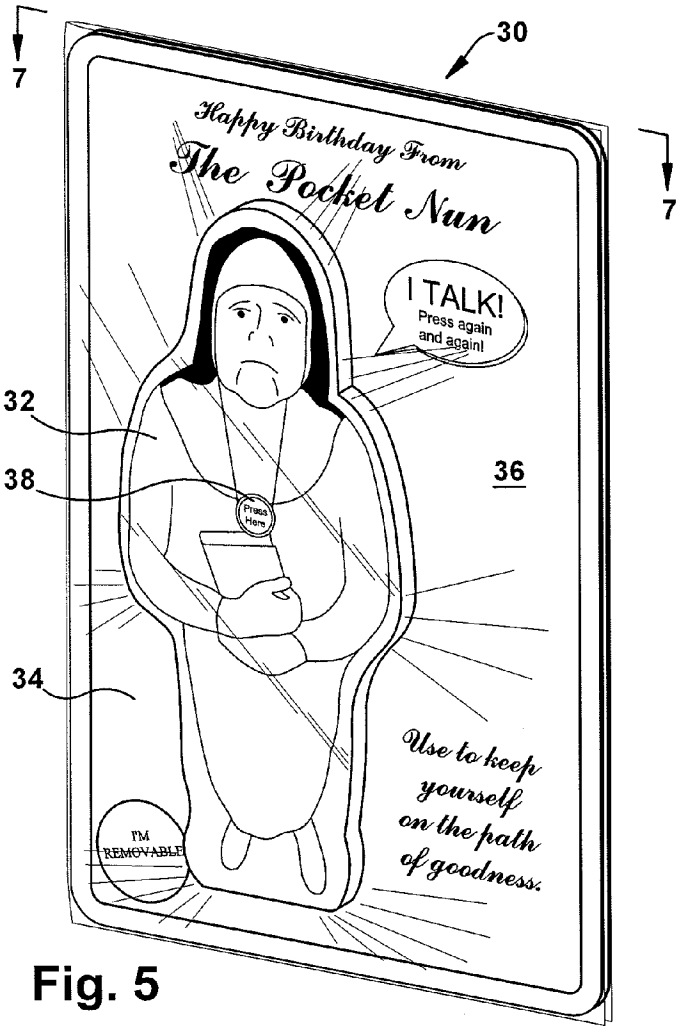
FIG. 5 is a perspective view of an alternate embodiment of the three-dimensional foam greeting card of the present invention in a closed position.

In another form, the three-dimensional foam greeting card of the present invention may be paired with a traditional paper greeting card, such as is shown in FIGS. 5-7. In this embodiment, the removable foam greeting card 32 may serve as a keepsake or token once the paper greeting 34 has been discarded. As shown in FIGS. 5-7, a sealed clear or transparent sleeve 36 made of plastic or other such material is used to pair the separate foam structure 32 and paper greeting card 34 in the same package. The foam structure 32 may be inserted into the sleeve 36 in front of the paper greeting card 34 so it is visible when looking at the greeting card 30 on a greeting card display. Alternatively, the foam structure 32 may be placed on the inside of the paper greeting card 34 to be discovered by the card recipient upon opening the greeting card 30. The foam structure 32 may contain sound, recording, light, motor, multimedia module, or combinations thereof as described in further detail below. As shown in the representative embodiment, the removable foam structure 32 contains a press button 38 which controls activation of an internal sound module, similar to the sound module shown in FIG. 4. Depression of the press button 38 may initiate playback of a pre-loaded audio file containing a voice message, music, sound, or any other digital recording.

Figure 11:
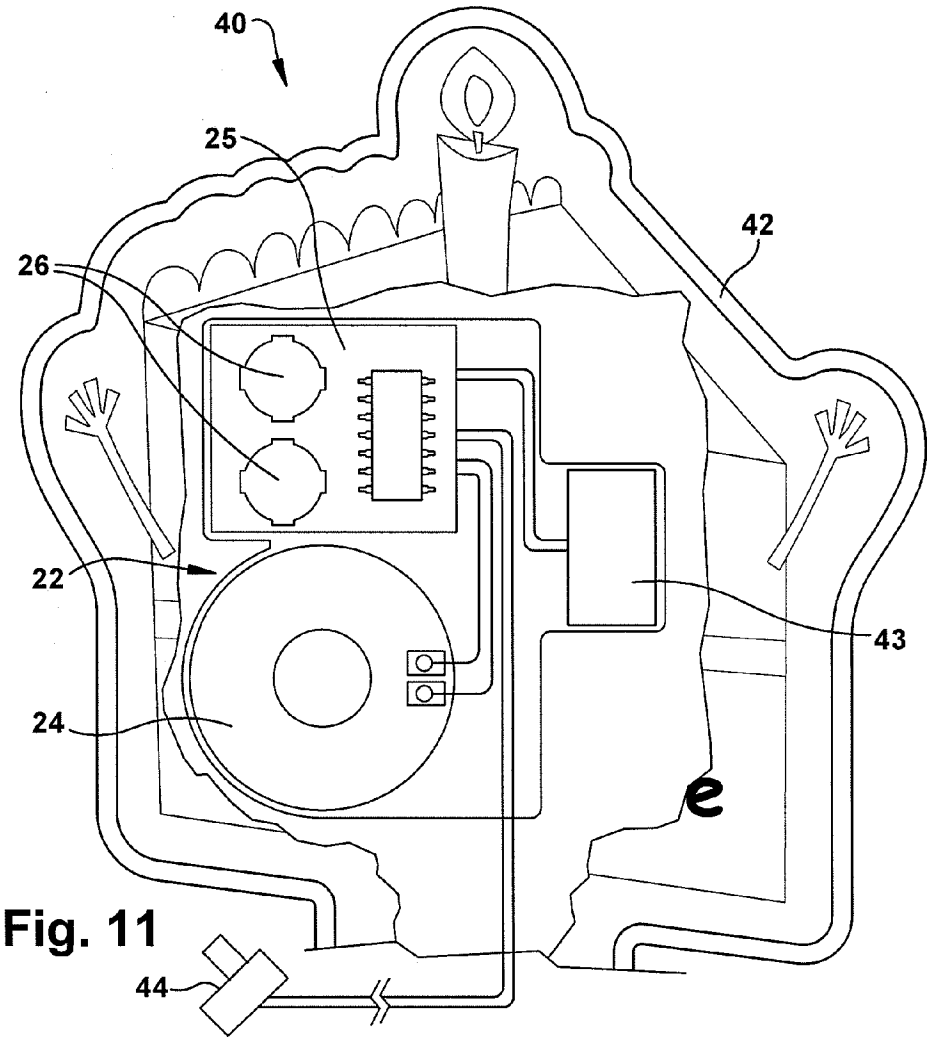
FIG. 11 is an internal view of a portion of the three-dimensional foam greeting card of FIG. 10.
Figure 10:
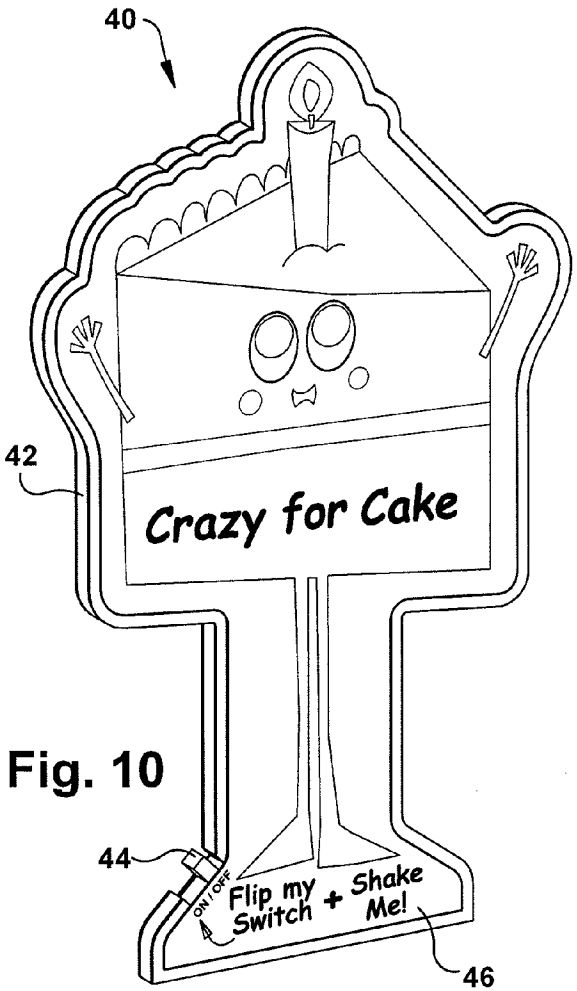
FIG. 10 is a perspective view of an alternate embodiment of the three-dimensional foam greeting card of the present invention.

The three-dimensional foam greeting card with sound, as described above, can additionally contain a motion sensor which operates to trigger one or more pre-loaded audio files. A representative example is shown in FIGS. 10-11. In this embodiment, in additional to the sound module 22 as described above, contains a motion sensor 43 within the cavity in the foam body 42. The motion sensor 43 can be used, in one embodiment, to trigger playback of a first pre-loaded audio file. In another embodiment, a first pre-loaded audio file may be played upon activating a first switch such as a push button switch or toggling a mechanical on/off button 44, as shown in FIGS. 10-11. After the first pre-loaded audio file is played back, movement of the foam body 42 activates the motion sensor 43, which triggers a second pre-loaded audio file. For example, the greeting card 40 may contain instructions to "shake me" 46 so that when the user begins to shake the foam body 42, the motion sensor 43 triggers playback of a pre-loaded audio file.

In another embodiment, the three-dimensional foam greeting card of the present invention may contain a light module with integrated LED lights. The light module would contain A light strand may be stored within a hollowed out portion of the greeting card body between the front and back surfaces of the card. The lights may be programmed to strobe in sequence or blink randomly. Different light colorations may be used as well. Other types of lighting, such as ribbon LED lights may also be used. An electro-mechanical push-activated switch may be used to allow the user to control whether the lights are turned on or off. Also, the lights may be used in combination with pre-recorded sound or a user-recorded message. A single switch may initiate playback of a pre-recorded or user-recorded message as well as turning the lights on or the audio playback and lights may be controlled by different switches.

In yet another embodiment, the three-dimensional foam greeting card of the present invention may contain a motor module located in the hollowed cavity in the foam located between the front and back panels of the greeting card. The motor module causes movement of at least one mobile object associated with the greeting card. The movement may be up and down motion, side to side lateral motion, or any other reciprocating motion. The motor module may contain a rotating gear mechanism that when activated turns a circular gear which is attached at one end to the mobile object. The mobile object can be any three dimensional object which extends outward from the front surface of the greeting card body. Activation of the motor module, which can be by a push button switch, slide switch, or any other switching mechanism, causes movement of the mobile object. Other novelties may be attached to the outside surface of the foam body such as moving eyes or other decorative embellishments.

Figure 13:
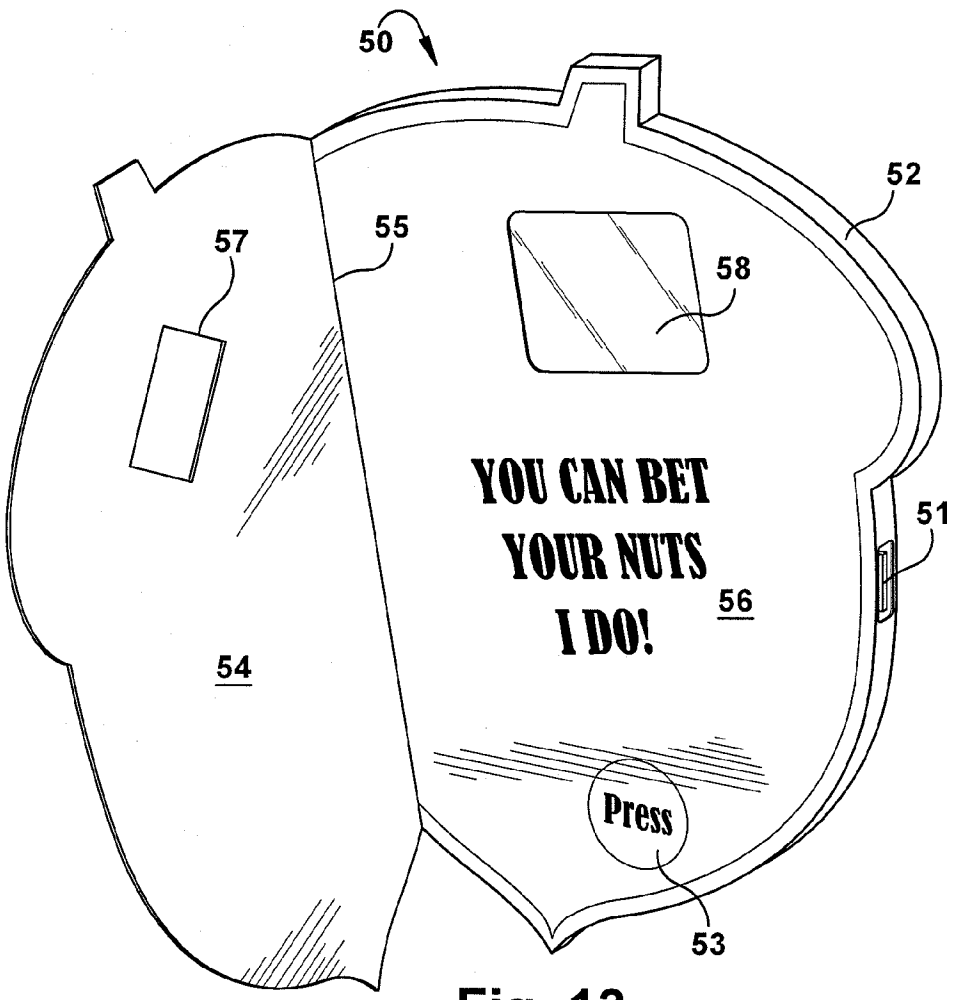
FIG. 13 is a perspective inside view of the three-dimensional foam greeting card of FIG. 12 in an open position.
Figure 12:
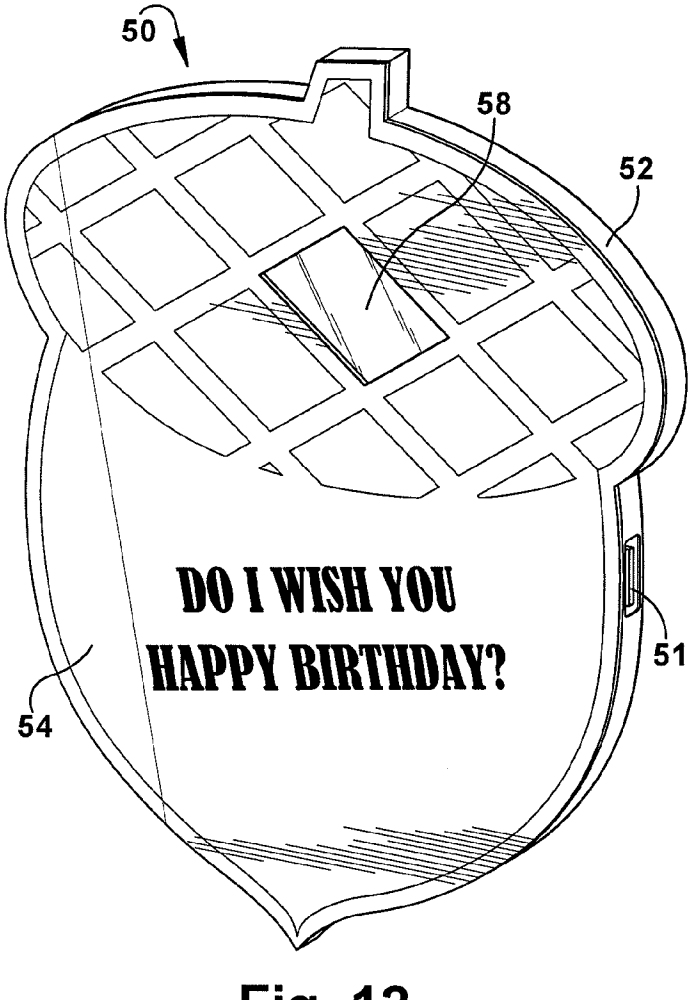
FIG. 12 is a perspective view of an alternate embodiment of the three-dimensional foam greeting card of the present invention in a closed position.

In still another embodiment, the three-dimensional foam greeting card of the present invention may be operative to play pre-loaded video and/or audio recordings. In this embodiment, a representative example of which is shown in FIGS. 12 and 13, a multimedia player device is contained within the hollowed cavity in the foam body 52 located between the front and back panels of the greeting card 50. The multimedia player device may be capable of displaying pre-loaded images or video and emitting sound. Components of such multimedia player device may include, but are not limited to, a flat panel display screen 58, such as an LCD screen, a power source which preferably consists of one or more disposable batteries, an audio speaker, integrated circuit, a circuit board with microprocessor, a data storage device and related circuitry. The device may contain at least one pre-recorded slideshow with accompanying pre-recorded digital audio files. A representative device may store up to approximately 20 pre-loaded photos or images and between approximately 26 seconds to 2.26 minutes of audio or greater, depending on the amount of digital storage provided. The device, when powered by four disposable lithium batteries, is capable of playing the pre-loaded audio/visual content approximately 300 times. Representative width and/or height dimensions of a display screen 58 are between approximately 1.5 and 2.4 inches. The screen 58 may be visible through an opening in the planar sheet material located on the front surface 56 of the foam body 52. The foam greeting card body 52 may additionally contain a sentiment panel 54, as described above, which is attached along a fold line 55 to the planar sheet material attached to the front surface 56 of the foam body 52. The sentiment panel 54 would serve as the front cover of the greeting card 50 and in a closed position, lay atop the sheet material attached to the front surface 56 of the foam body 52. The sentiment panel 54 may also contain an opening thereon 57, consistent with the opening for the display screen 58 contained on the planar sheet material located on the front surface 56 of the foam body 52, through which the display screen 58, contained within the foam body 52, is visible. The multimedia display device may be activated by a push button switch 53 located on the front or back surface of the foam body 52. The greeting card 50 may contain the words "play" printed above the push button switch 53 which indicates where the multimedia player device is activated. Alternatively, the greeting card 50 may contain a slide switch which is used in combination with a sentiment panel 57, as described above. The slide switch may be located across a fold line 55 between the sentiment panel 54 and the foam greeting card body 52, such that when the greeting card 50 is opened or the sentiment panel 54 is folded away from the greeting card body 52, the slide switch works to activate the multimedia player. The greeting card 50 may additionally contain a mechanical on/off switch or button which controls whether or not the multimedia player device may be activated. The on/off switch may be located along the side perimeter of the foam body 52 between the planar sheet material located on the front and back surfaces of the foam body or it may be located on the front or back surface of the greeting card body.

A further embodiment of the three dimensional foam greeting card with multimedia player device, as described directly above, may contain audio recording capabilities which would provide a user with the ability to record a personalized message to be played before, during or after the pre-recorded slideshow is displayed on the display screen. Additional components such as a sound and recording module, as described above with reference to a previous embodiment, would accompany the multimedia player device within the cavity located within the foam body between the front and back panels of the greeting card. The multimedia player device may contain one or more pre-recorded audio files that may be played before during or after the personalized user recorded message.

Further still, the three dimensional foam greeting card with multimedia player device may additionally include a USB port 51, SD slot or any other appropriate external memory input source so that a user may upload digital video, digital photos and/or digital audio files to be presented on activation of the multimedia device. The multimedia device may be capable of playing several file formats including, but not limited to, flash, html, html5, mp3, mp4, .mov, .rp4, /wma, etc. The multimedia player device may also contain one or more pre-loaded digital video, photo and/or audio files which may be played in combination with the user uploaded digital video, photo and/or audio. The video, slideshow and/or audio may be triggered by any of the switch mechanisms described herein and playback may further be controlled by a mechanical on/off switch. The switch mechanisms may be located on the front or back of the greeting card or along the side perimeter of the foam structure.

Figure 15:
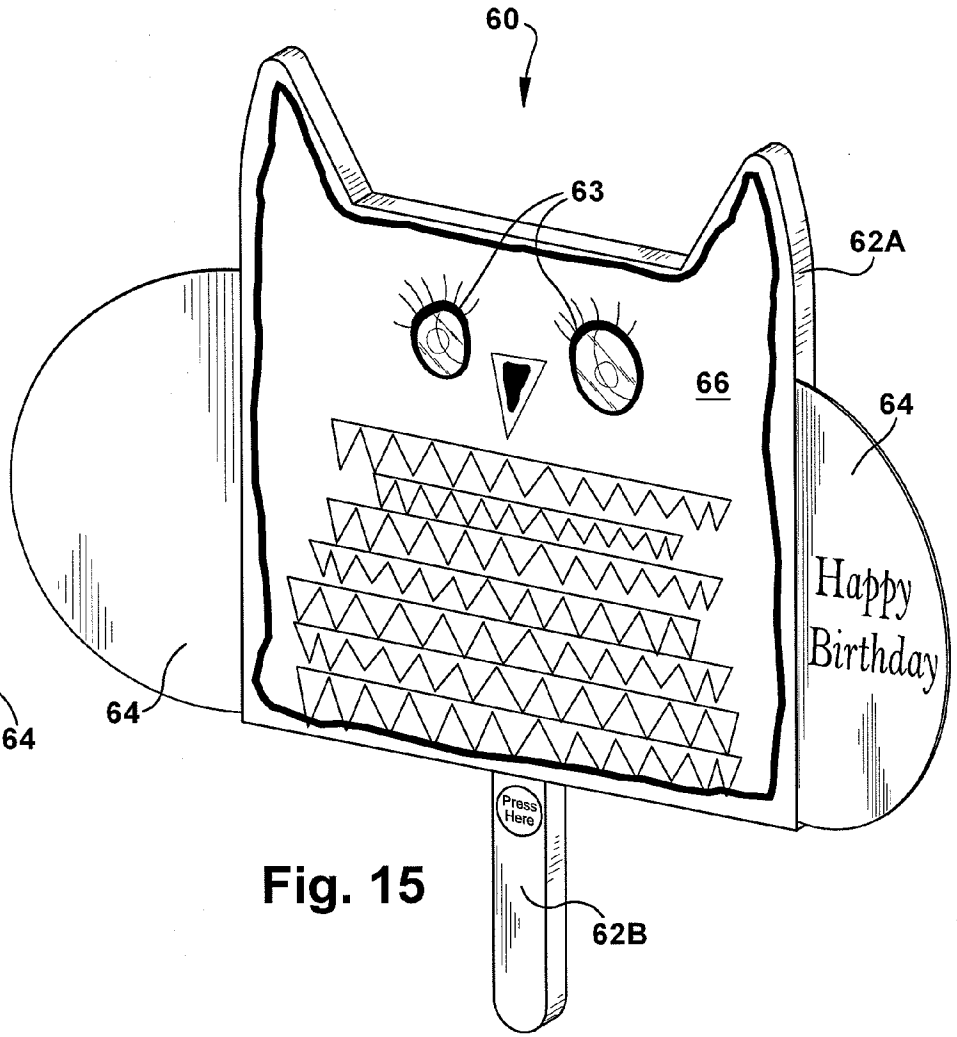
FIG. 15 is a perspective view of the foam greeting card of FIG. 14, in an open position.
Figure 14:
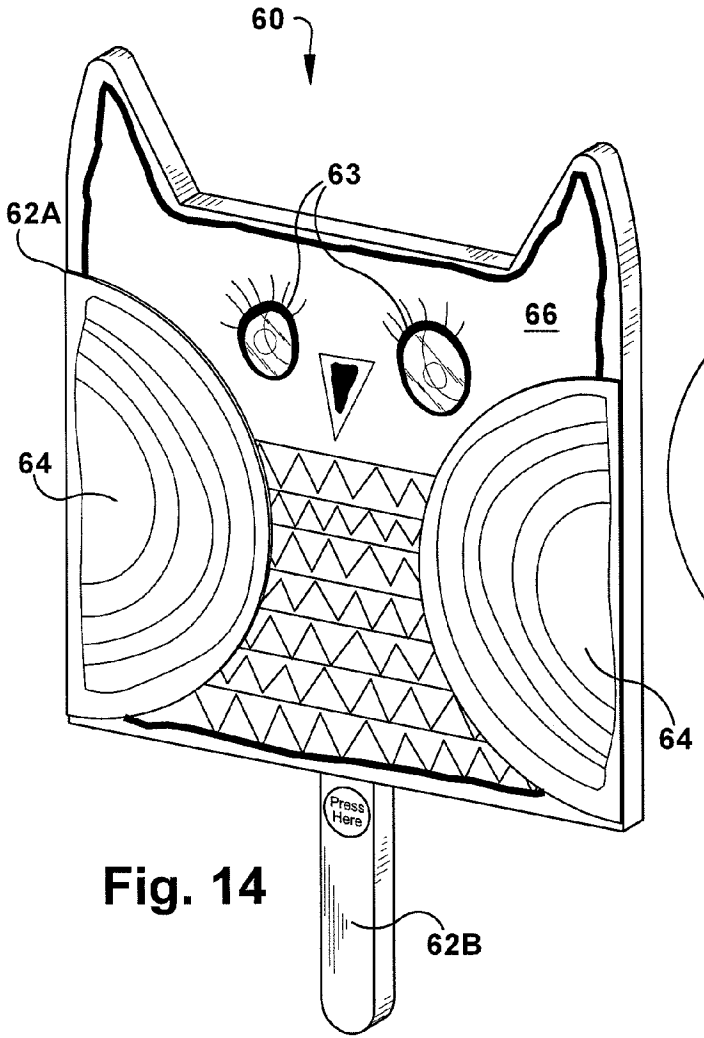
FIG. 14 is a perspective view of an alternate embodiment of the three-dimensional foam greeting card of the present invention, in a closed position.
Figure 16:
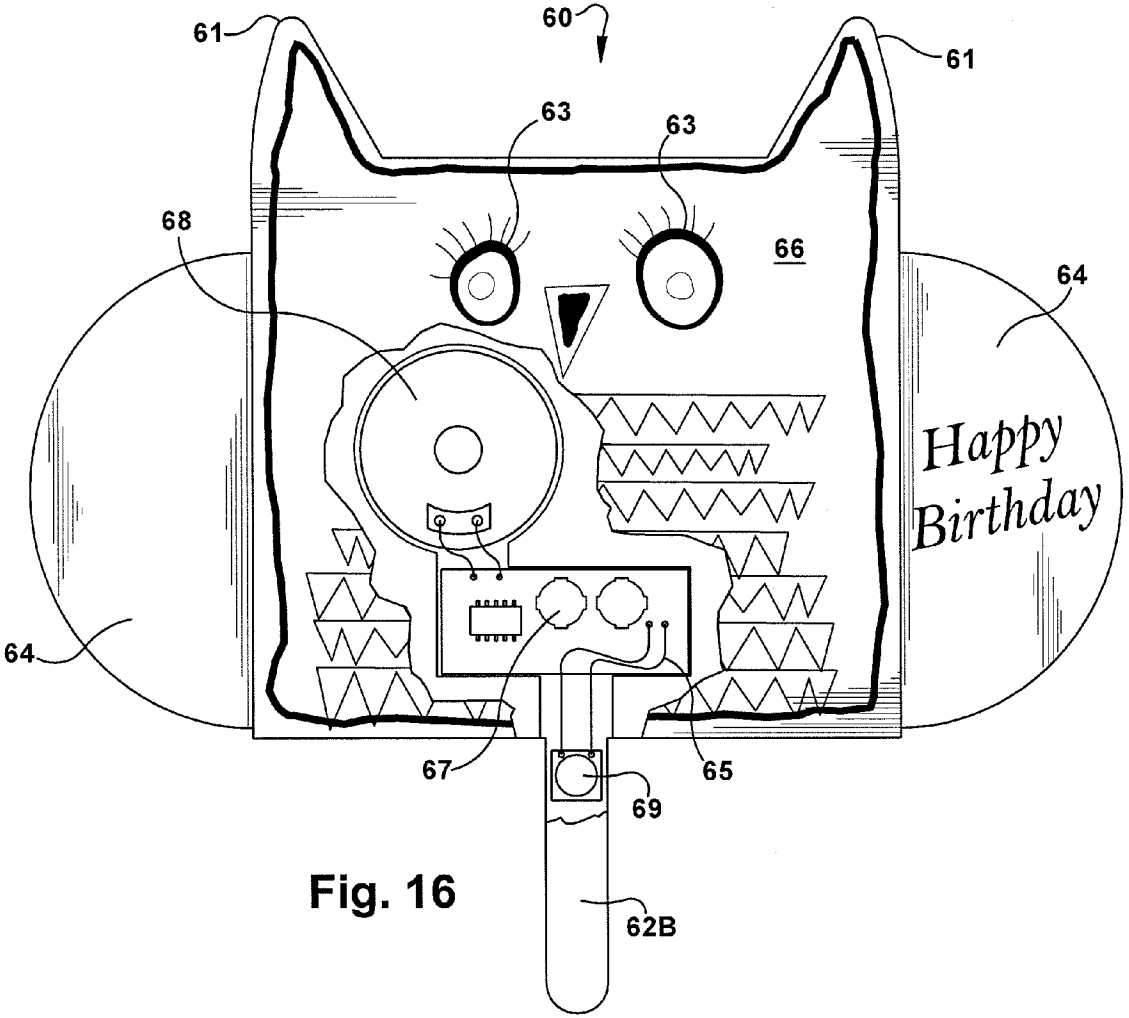
FIG. 16 is a front break-away view of the foam greeting card of FIG. 14.

Another embodiment of the three-dimensional foam greeting cards of the present invention is shown in FIGS. 14-16. This embodiment includes a foam body 62 which serves as both a hand-held masquerade-style mask or face shield and a greeting card. The foam body 62 is combined with one or more panels or flaps 64, a sound module and switch 69 for initiating playback of a pre-recorded audio file.

The foam body 62 consists of a three-dimensional shaped foam piece having a front side and a back side opposite the front side with a perimeter wall therebetween. In the example shown, the foam body 62 is approximately between ¼ and ½ inches thick but can be of any suitable thickness. The front, back and perimeter wall are substantially planar. The foam body 62 has an upper portion 62A, which serves as the mask or face shield portion and a lower portion which serves as a grip or handle 62B. The upper and lower portions 62A, 62B of the foam body 62 are integral as one single piece of foam shaped in the manner described above, but can however, be two or more separate pieces of foam which are otherwise attached. The foam body 62 may contain one or more openings or cavities thereon for storage of a sound module or other electronic components. The lower handle portion 62B of the foam body 62 is generally rectangular with a rounded end opposite the upper portion 62A of the foam body 62 (although the handle may be of any suitable shape). The grip or handle 62B generally bisects the upper portion 62A of the foam body 62 along a bottom edge. In the example shown in the Figures, the upper 62A or greeting card portion of the foam body 62, has a generally square shape with two generally triangular shapes 61 extending from two opposite corners along a top edge of the upper portion 62A of the foam body 62. While the example described herein and shown in the Figures has a generally square shape with two generally triangular shapes extending from a top edge thereof, the foam body may take any conceivable shape with various shapes extending out therefrom. The upper portion 62A also contains two apertures or openings 63 proximate to the top edge thereof (however, the two apertures or openings 63 may be located anywhere on the foam body 62). The two apertures or openings 63 extend through the entire foam body 62 and are spaced apart from but proximate to each other and on the same level, as they are used as eye holes when the greeting card 60 is being used as a mask. The two apertures or holes 63, in the example shown, are generally circular openings however, they may be of any shape or any size. The two apertures or openings 63 may be covered by a clear or transparent plastic or transparent or translucent material. The material may cover the two openings across the front wall, the back wall, or preferably across both the front and back walls. Alternatively, the apertures or openings 63 may contain no cover material. The size of the upper portion 62A of the foam body 62, which serves as the mask, is approximately between 5 and 10-inches tall and between 5 and 10 inches wide. The upper portion 62A is meant to fit in front of and cover a substantial amount of a child's face, while looking through the eye holes 63. A generally planar sheet material 66 is placed over the front and back surfaces of the foam body 62, with the exception of the two apertures or openings 63 in the foam body 62. The perimeter wall which extends between the front and back surface of the foam body 62 may be left uncovered or may be covered with a same or different sheet material. The sheet material 66 is preferably card stock or other such material which is durable and capable of having printing thereon. Other materials such as plastics or other paper-based materials may be used. The front and back sheet material 66 contains printing thereon which makes the foam body 62 into an animal or other entertaining character. In the example shown in FIGS. 14-16, the front and back sheet material 66 have printing thereon which makes the foam body 62 appear to be an owl, with the two triangular projections 61 located at the opposite corners of the top edge of the foam body 62, appearing as two ears. The front sheet material 66 depicts a front face or frontal view of an owl and the back sheet material (not shown) depicts a back or rear view of the owl. The planar sheet material 66 may be decorated in any way, depicting animals, such as a cat, a dog, a lion, a bear, or any other animal, person or character. The sheet material 66 is typically the same shape as the foam body 62, wherein the foam body 62 takes the shape of the animal, character, etc. and the sheet material 66 further defines the face or head of the animal, character, etc. with printing thereon. Embellishments, such as beads, moving eyes, or other such effects may be attached to the sheet material 66. The lower portion of the foam body, which serves as the grip or handle 62B, is also covered by the same sheet material 66, the sheet material printed to make the grip or handle 62B look like a wooden handle or popsicle stick. The front sheet material 66 which is attached to the front surface of the foam body 62 contains two extension panels 64 which extend outward from the right and left sides of the sheet material 66 covering the upper portion 62A of the foam body 62. The two extension panels 64, in the example shown, are attached to the front sheet material 66 along two opposing fold lines. The panels 64 have an arched or half-circular shape however, they may be square, rectangular, or may be of any other conceivable linear or non-linear shape. The two extension panels 64 are folded along the two opposing fold lines to overlap a portion of the front sheet material 66. The extension panels 64 may also be printed on an outer surface with the same decorative theme as the front sheet material 66. In the example shown, the two extension panels 64 appear to be wings or feathers. In other embodiments, one or more panels or flaps may be added to the sheet material 66 or foam body and may appear in any location thereon. The extension panels 64 also serve as two greeting card panels. Both panels 64 may be opened or unfolded by pivoting each panel along the fold line connecting the panels 64 to the front sheet material 66. The inside surface of the panels 64 may contain printed verse such as "Happy Birthday" or other such greeting card sentiments. A sound module which is capable of storing, controlling and initiating playback of at least one digital audio file is contained within the one or more cavities in the foam body 62 and are preferably concealed by the front and back sheet material 66. The sound module may contain, but is not limited to: a printed circuit board 65, an integrated circuit chip, a power source 67 such as one or more batteries, a speaker 68, a memory storage device, at least one digital audio file contained on the memory storage device, a switch 69, an any other component or device which facilitates storage and playback of one or more digital audio files. The greeting card 60 may also contain other components which facilitate other special effects such as lights, mechanical, electrical, or electro-mechanical moving parts, or other such special effects. The greeting card 60 may also contain a microphone and other components for recording and playing back user-recorded personalized messages. In the example shown, a plurality of digital audio files or a single audio file with several sounds or phrases are contained within the sound module. A press-button switch 69 is contained within the foam body 62 and is accessed through the front or back surface of the grip or handle portion 62B of the foam body 62. When a user presses the press-button switch 69, a digital clip is replayed. The digital clip may be a verbal phrase such as "Happy Birthday" or any other such phrase or may be a sound or noise, such as an animal sound or may contain a verbal song and/or instrumental music. Several different audio clips may be cycled through by continuing to push the press-button 69. The audio clips may be arranged in a particular sequence or may be played back randomly. Any number of different clips may be stored on the memory device and played back upon pushing the press-button. In the example shown, the sound module cycles through five different audio clips in sequence and then repeats the sequence once the entire sequence has been replayed. The sound module may alternatively only contain a single sound or audio clip upon pushing the press-button. Although a press-button switch 69 is disclosed with regard to the described embodiment, any other type of switch mechanism may be used. Upon presenting the greeting card 60 to a recipient, the recipient may open the external flaps 64 to reveal the text sentiment and/or graphics and may push the press-button 69 to reveal an audio clips. Thereafter, the greeting card 60 may be used as a novelty hand-held mask, whereby a user may hold the greeting card 60 up to his/her face by the grip or handle portion 62B and looking through the two eye holes or openings 63. The entire foam greeting card 60 may be packaged together with a size-appropriate envelope in a transparent envelope or packaging so that the greeting card can be seen through the packaging. A separate insert may also be contained therein to shown the inside sentiment and give instructions for opening the greeting card 60 and initiating playback of the audio clips. The insert may be located behind or opposite the greeting card so a consumer can view the front of the greeting card from a front side of the package or envelope and view the insert from the rear or opposite side of the package. This novel greeting card device combines a greeting card with sound and a mask to provide greater entertainment value to children or other greeting card recipients.

The three-dimensional foam greeting cards of the present invention may also contain a battery-saving device which includes a small substantially rectangular plastic insert which is inserted into a small slot in the foam body. The slot is located directly outside the location of a battery circuit switch which is contained on the circuit board inside the foam body. When the device is inserted into the slot the circuit is opened, preventing batteries from draining while the product is not in use. When the device is removed, the circuit closes, and the batteries are activated, allowing the user to record a message, play an audio clip, light up the greeting card or cause components of the greeting card to be put in motion.

It should be noted that the three-dimensional foam greeting card described herein may contain one or a combination of two or more functions, as described, such as sound, light, audio, recording, motion, or multimedia functions. Additionally, a variety of switches are mentioned herein and can be used alone or in combination and may be located in a variety of locations on the three-dimensional foam greeting card.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A foam greeting card comprising:

a foam body having a front side and a back side opposite the front side and a perimeter wall therebetween;

a front surface material covering the front side of the foam body and a back surface material covering the back side of the foam body;

a sound module contained within a cavity in the foam body operative to store and playback of at least one digital audio file;

the foam body having an upper portion and a lower portion, the upper portion serving as a mask having two apertures contained thereon and the lower portion serving as a handle;

a press-button accessed through a front side of the foam body, which initiates playback of the at least one digital audio file.

2. The foam greeting card of claim 1 further comprising at least one sentiment panel attached to and folded over the front surface material, the at least one sentiment panel having a written sentiment contained on an inside surface which is revealed by unfolding the at least one sentiment panel away from the front surface material.

3. The foam greeting card of claim 2, wherein there are two sentiment panels attached to opposite sides of the front surface material, both sentiment panels having written sentiment contained on an inside surface.

4. The foam greeting card of claim 1, wherein a transparent material covers the two apertures.

5. The foam greeting card of claim 1, wherein the sound module contains a plurality of digital audio files.

6. The foam greeting card of claim 1, wherein the sound module contains a plurality of sound clips, one sound clip replayed after pushing the press-button.

7. The foam greeting card of claim 1, wherein the press-button located on the lower portion or handle of the foam body.

8. A foam greeting card comprising:

a foam body having an upper portion which serves as a mask and a lower portion which serves as a handle;

a sound module contained within one or more cavities in the foam body, the sound module operative to store and playback one or more digital audio files;

a front surface material which covers the front surface of the foam body;

two sentiment panels having an outer surface and an inner surface, a first sentiment panel attached to a left side edge of the front surface material along a first fold line, a second sentiment panel attached to a right side edge of the front surface material along a second fold line, the first sentiment panel folded about the first fold line such that it covers a portion of the front surface material, the second sentiment panel folded about the second fold line such that it covers a portion of the front surface material;

a press button contained on the lower portion of the foam body which initiates playback of one sound clip each time the press button is pushed;

wherein folding the first and second sentiment panels away from the front surface material reveals printed text sentiment printed on the inner surface of the first and second sentiment panels.

9. The foam greeting card of claim 8 further comprising a back surface material covers the back surface of the foam body.

10. The foam greeting card of claim 8, wherein the upper portion of the foam body contains two openings which extend through the foam body.

11. The foam greeting card of claim 10, wherein the two openings are covered by a transparent material.

12. The foam greeting card of claim 8, wherein the foam body is in the shape of an animal.

13. The foam greeting card of claim 12, wherein the front surface material has printing thereon which makes the foam body look like an animal.

14. The foam greeting card of claim 8, wherein the sound module contains a plurality of sound clips which are played back in sequence.

15. A foam greeting card comprising:

a foam face shield shaped like the head of an animal, having two apertures contained therethrough;

a sound module contained and concealed within the foam face shield, the sound module operative to store and playback a plurality of sound clips;

a handle attached to a lower edge of the foam face shield;

a press button located on the handle, operative to replay one sound clip each time the press button is pushed;

a greeting card panel attached to a front surface of the foam face shield containing text sentiment printed thereon.

16. The foam greeting card of claim 15, wherein the plurality of sound clips are replayed in sequence.

17. The foam greeting card of claim 16, wherein the two apertures through the foam face shield are located on an upper portion of the face shield and are located at the same elevation.

18. The foam greeting card of claim 16, wherein the two apertures on through the foam face shield are covered by a transparent material.

19. The foam greeting card of claim 16, wherein the foam face shield is between 5 and 10 inches wide and between 5 and 10 inches high.

20. The foam greeting card of claim 16, wherein the handle is integral with the foam face shield.

* * * * *